US007347325B2

(12) United States Patent
O'Neill et al.

(10) Patent No.: US 7,347,325 B2
(45) Date of Patent: Mar. 25, 2008

(54) CARRYING CASE FOR PERSONAL ARTICLES

(75) Inventors: Michael O'Neill, San Francisco, CA (US); Arik Keller, Amesbury, MA (US); Tony Liporice, Clarksburg, MA (US); Mark Gamache, Dalton, MA (US)

(73) Assignee: Mr. Smith, Inc., Amesbury, MA (US)

( * ) Notice: Subject to any disclaimer, the term of this patent is extended or adjusted under 35 U.S.C. 154(b) by 6 days.

(21) Appl. No.: 11/176,171

(22) Filed: Jul. 7, 2005

(65) Prior Publication Data

US 2006/0016810 A1 Jan. 26, 2006

Related U.S. Application Data

(60) Provisional application No. 60/586,101, filed on Jul. 7, 2004.

(51) Int. Cl.
*B65D 85/48* (2006.01)

(52) U.S. Cl. ..... 206/449; 206/38; 206/39

(58) Field of Classification Search ..... 206/37–39, 206/38.1, 39.5, 234, 305, 449; 220/4.01
See application file for complete search history.

(56) References Cited

U.S. PATENT DOCUMENTS 2,713,368 A * 7/1955 Thomas ..... 206/39
3,092,244 A * 6/1963 McWhirter ..... 206/38
4,071,065 A * 1/1978 Halbich ..... 206/320
4,768,648 A * 9/1988 Glass ..... 206/38
4,934,528 A * 6/1990 Miller et al. ..... 206/235
5,630,546 A * 5/1997 Velch ..... 206/449
6,708,826 B1 * 3/2004 Ginsberg et al. ..... 206/425
6,968,967 B1 * 11/2005 Burns ..... 206/38.1
2003/0052786 A1 * 3/2003 Dickinson ..... 206/594

* cited by examiner

*Primary Examiner*—Luan K. Bui
(74) *Attorney, Agent, or Firm*—Pandiscio & Pandiscio

(57) ABSTRACT

A carrying case system comprising: a wallet-sized carrying case for holding personal items, the wallet-sized carrying case comprising: a substantially rigid front panel comprising a four-sided planar body and an upstanding rim extending along three sides of the four-sided planar body;a substantially rigid rear panel comprising a four-sided planar body and an upstanding rim extending along three sides of the four-sided planar body; and a lid; wherein the front panel is hingedly connected to the rear panel such that their respective rims can be brought into engagement with one another so as to form an enclosure with an open face; and wherein the lid is hingedly connected to the rear panel such that the lid can be brought into engagement with the front panel so as to close off the open face of the enclosure.

31 Claims, 12 Drawing Sheets

CARRYING CASE FOR PERSONAL ARTICLES

REFERENCE TO PENDING PRIOR PATENT APPLICATIONS

This patent application claims benefit of pending prior U.S. Provisional Patent Application Ser. No. 60/586,101, filed Jul. 7, 2004 by Michael O'Neill et al. for CARRYING CASE FOR PERSONAL ARTICLES.

The above-identified patent application is hereby incorporated herein by reference.

FIELD OF THE INVENTION

This invention relates to carrying cases in general, and more particularly to carrying cases for personal articles such as credit cards, licenses, identification cards, money and the like.

BACKGROUND OF THE INVENTION

In many situations it may be necessary to carry personal articles such as credit cards, licenses, identification cards, money and the like.

Conventional leather wallets are commonly used for this purpose. However, in many situations (e.g., sports activities such as jogging, bicycling, snowboarding and hiking, water environments such as rafting and kayaking, inclement weather such as rainstorms, casual outings such as running a quick errand, etc.), the use of formal (and frequently overstuffed) leather wallets may be undesirable. This can be particularly true where it is necessary to carry only a small subset (e.g., a license and one credit card) of the articles normally contained in a person's formal wallet.

As a result, it is desirable to provide a new and improved carrying case for personal articles so as to facilitate the safe and convenient transport of the same.

SUMMARY OF THE INVENTION

This and other objects are addressed by the provision and use of the present invention which comprises, in one preferred form of the invention, a carrying case system comprising:

- a wallet-sized carrying case for holding personal items, the wallet-sized carrying case comprising:
  - a substantially rigid front panel comprising a four-sided planar body and an upstanding rim extending along three sides of the four-sided planar body;
  - a substantially rigid rear panel comprising a four-sided planar body and an upstanding rim extending along three sides of the four-sided planar body; and
  - a lid;
  - wherein the front panel is hingedly connected to the rear panel such that their respective rims can be brought into engagement with one another so as to form an enclosure with an open face; and
  - wherein the lid is hingedly connected to the rear panel such that the lid can be brought into engagement with the front panel so as to close off the open face of the enclosure.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like parts, and further wherein:

FIG. 12 is a schematic view of a template for sizing photographs and the like.

DETAILED DESCRIPTION OF THE PREFERRED EMBODIMENTS

Basic Construction

Looking first at FIGS. 1-4, there is shown a novel carrying case 5 formed in accordance with the present invention. Carrying case 5 generally comprises a substantially rigid front panel 10, a substantially rigid back panel 15, and a substantially rigid lid 20.

Figure 1:
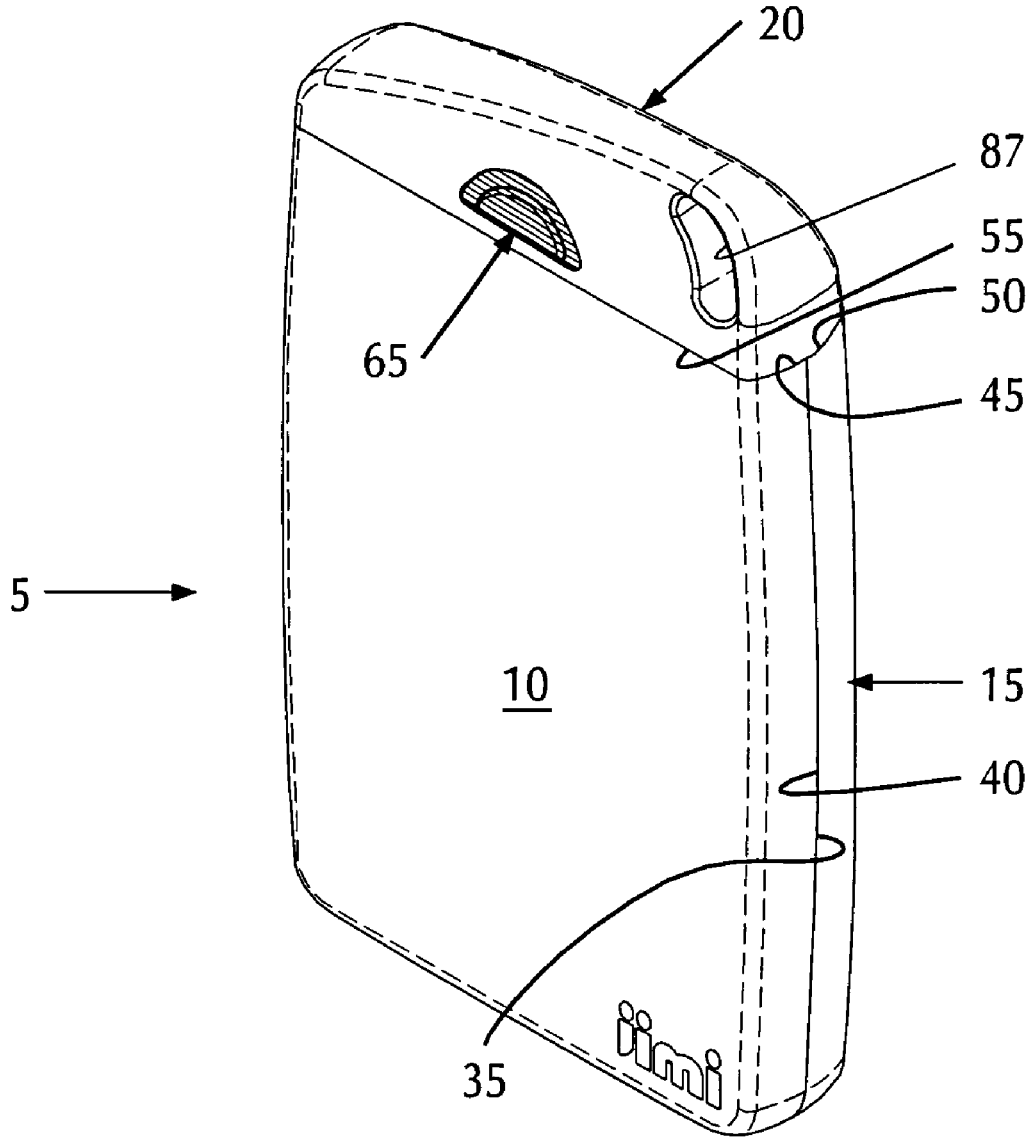
FIGS. 1-4 are schematic views of a novel carrying case for personal articles.

Front panel 10 and back panel 15 are hingedly connected to one another via a living hinge 25, and back panel 15 and lid 20 are hingedly connected to one another by a living hinge 30. The upraised side edges 35 and 40 of front panel 10 and back panel 15, respectively, are formed so that they can releasably snap-lock to one another when front panel 10 and back panel 15 are brought into confronting relationship with one another, e.g., in the manner shown in FIG. 1. Furthermore, the top edges 45 and 50 of front panel 10 and side panel 15, respectively, and the bottom edges 55 of lid 20 are formed so that they can releasably snap-lock to one another when lid 20 is brought into confronting relationship with the previously-joined front and back panels (FIG. 1).

Releasable snap-locking is preferably achieved by the edge of one component "accepting" the edge of another component. This locking may be effected in a variety of ways, e.g., by one side having a raised edge and the other side a slight depression to meet the raised edge, or the two sides meeting in a side-by-side overlap, etc.

It will be appreciated that the closure of lid 20 against the previously-joined front and back panels will also help ensure that the front and back panels remain closed. Thus, lid 20 also essentially "locks" front panel 10 and back panel 15 together when lid 20 is in its "closed" position (i.e., the position of FIG. 1).

Figure 2:
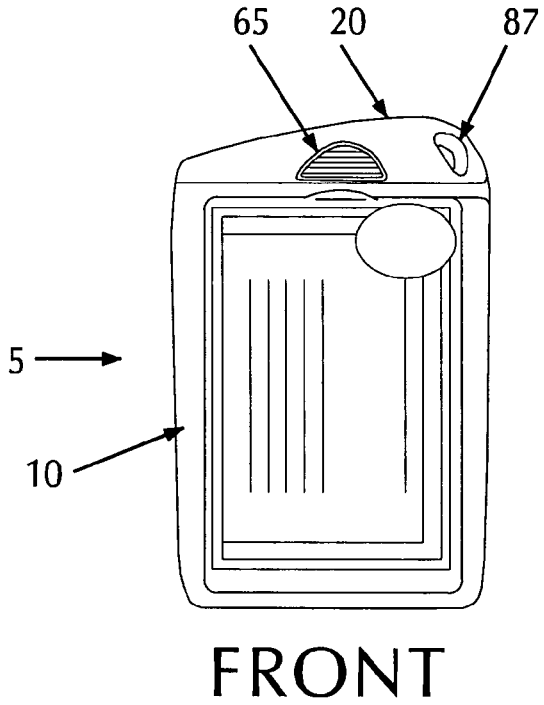
Figure 4:
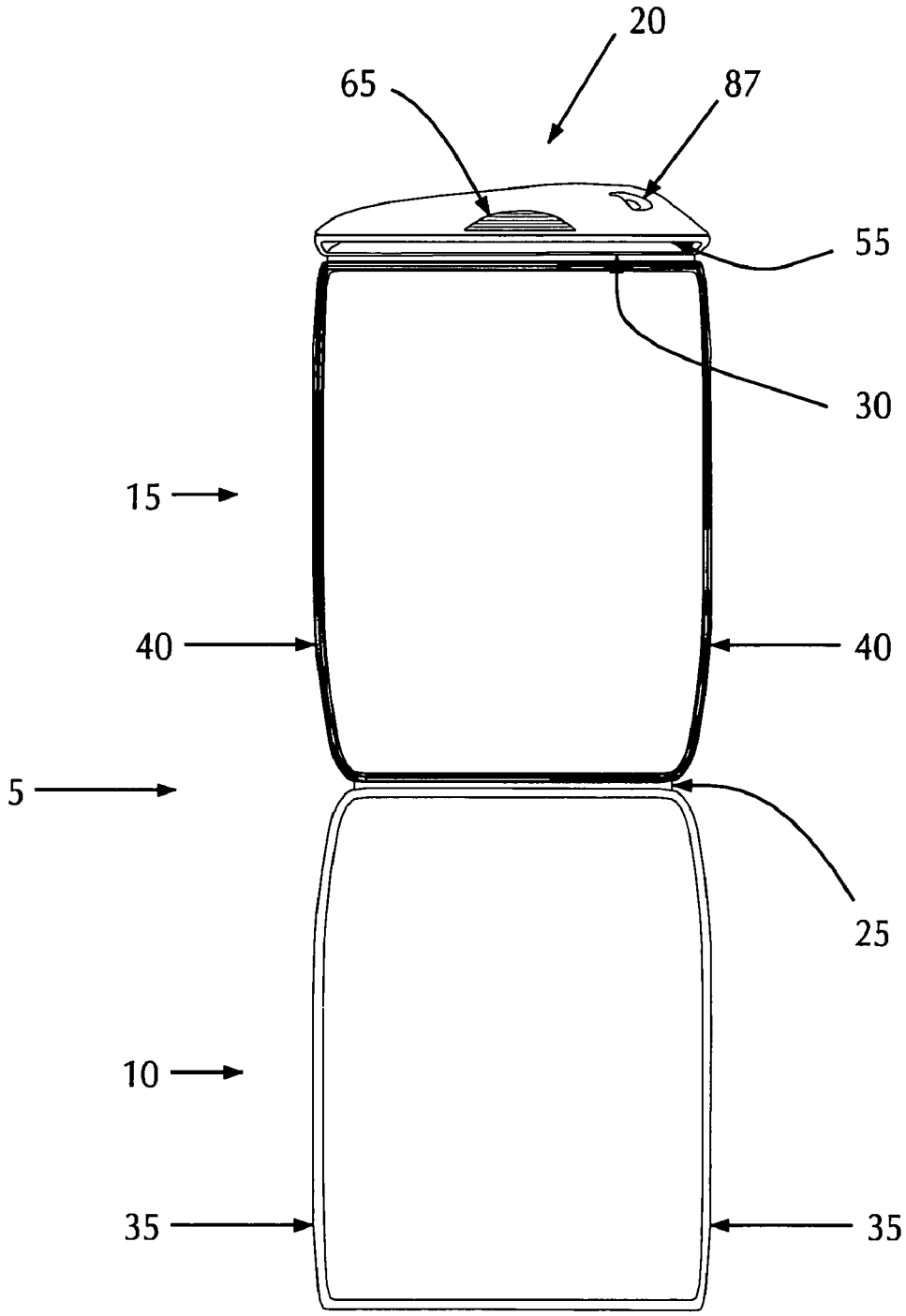
Figure 5:
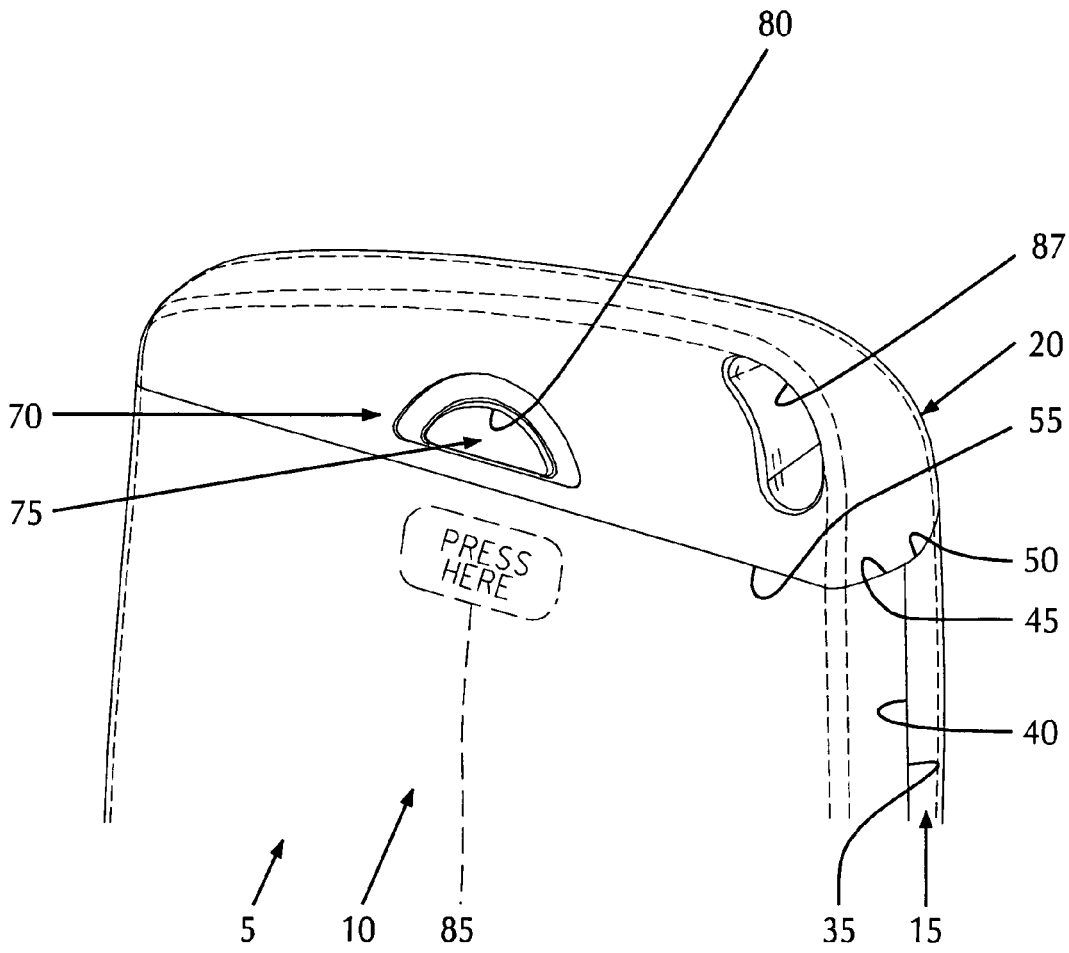
FIG. 5 is a schematic view of the novel carrying case of FIGS. 1-4, but modified to incorporate a tongue-and-hole latch.

Preferably lid 20 has means to assist opening the lid relative to the previously-joined front and back panels. In a simple form, these means may comprise a simple friction grip 65 (FIGS. 1, 2 and 4). Alternatively, and more preferably, these means comprise a push-button release latch 70 (FIG. 5). Latch 70 comprises a flexible tongue 75 attached to front panel 10 and a counterpart opening 80 formed in lid 20. By depressing a target area 85 on front panel 10, tongue 75 is released from opening 80 in lid 20 and allows lid 20 to be opened relative to the previously-joined front and back panels. See also FIGS. 6-8, which show the tongue 75.

In essence, carrying case 5 comprises a substantially rigid front panel 10 comprising a four-sided planar body and an upstanding rim 35, 45 extending along three sides of the four-sided planar body; a substantially rigid rear panel 15 comprising a four-sided planar body and an upstanding rim 40, 50 extending along three sides of the four-sided planar body; and a lid 20; wherein the front panel 10 is hingedly connected to the rear panel 15 such that their respective rims can be brought into engagement with one another so as to form an enclosure with an open face; and wherein the lid 20 is hingedly connected to the rear panel 15 such that the lid can be brought into engagement with the front panel 10 so as to close off the open face of the enclosure.

Thus it will be seen that carrying case 5 has three basic states:

(i) Closed State (FIGS. 1, 2 and 5): where front panel 10 and back panel 15 are snap-locked to one another, and lid 20 is snap-locked to the previously-joined front and back panels, so as to form a fully-closed enclosure;

(ii) Open-Lid State (FIG. 3): where front panel 10 and back panel 15 are snap-locked to one another, but lid 20 is opened relative to the previously-joined front and back panels, so as to provide top access to the partial enclosure formed by the previously-joined front and back panels (e.g., so that the carrying case can be tipped so as to "spill out", in a controlled fashion, the contents of the carrying case); and (iii) Fully-Opened State (FIG. 4): where the carrying case is opened like a book, revealing the interiors of front panel 10 and back panel 15, so as to provide complete access to the contents of the carrying case.

Thus it will be seen that carrying case 5 essentially comprises a two-hinged (i.e., hinges 25 and 30) receptacle for carrying personal items, with the carrying case providing different degrees of access depending on its current configuration.

Carrying case 5 is preferably formed out of a water-impervious, substantially rigid material, with the various components forming substantially splashproof or watertight seals when brought into engagement with one another, so as to form a protective case. If desired, this splashproof or watertight seal may be enhanced by the addition of a gasket at the edges of the components, or by lining each compartment with a soft elastomeric (e.g., rubber, silicone, etc.) material. See also FIG. 9, which shows a gasket 86 on the bottom edges of lid 20. In one preferred construction, carrying case 5 is formed out of polypropylene; however, carrying case 5 can also be formed out of another suitable material, for example, other plastics, metals (including precious metals), wood, a vegetable-based composite, Kevlar, etc. If desired, carrying case 5 can be formed out of a recycled (or recyclable) material.

Figure 3:
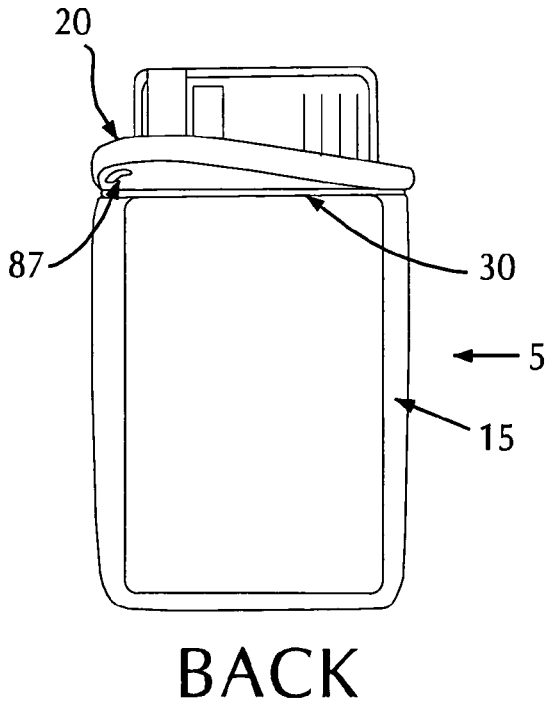

As seen in FIGS. 2 and 3, carrying case 5 is preferably sized so as to be slighter larger than the size of a standard credit card so as to conveniently accommodate the same (or other objects of approximately the same size, as will hereinafter be discussed).

In one form of the invention, lid 20 includes an attachment hole 87, which can be used for attaching the carrying case to a lanyard, string, thong, chain, neck attachment, wrist attachment or pants attachment, etc. Alternatively, hole 87 can be used to attach a key ring or other personal item to carrying case 5. Preferably, hole 87 is closed to the interior of carrying case 5 (i.e., so that no water may enter the interior of carrying case 5 through hole 87).

Interior Elements

It is also possible to add elements to the interior(s) of front panel 10 and/or back panel 15, so as to provide additional features to carrying case 5. By way of example but not limitation, these additional elements can provide a money clip feature, or additional internal compartments, etc. The additional elements for these features can be formed as an integral part of front panel 10 and/or back panel 15 or, more preferably, they can be formed separately from front panel 10 and back panel 15 and attached thereto.

Figure 6:
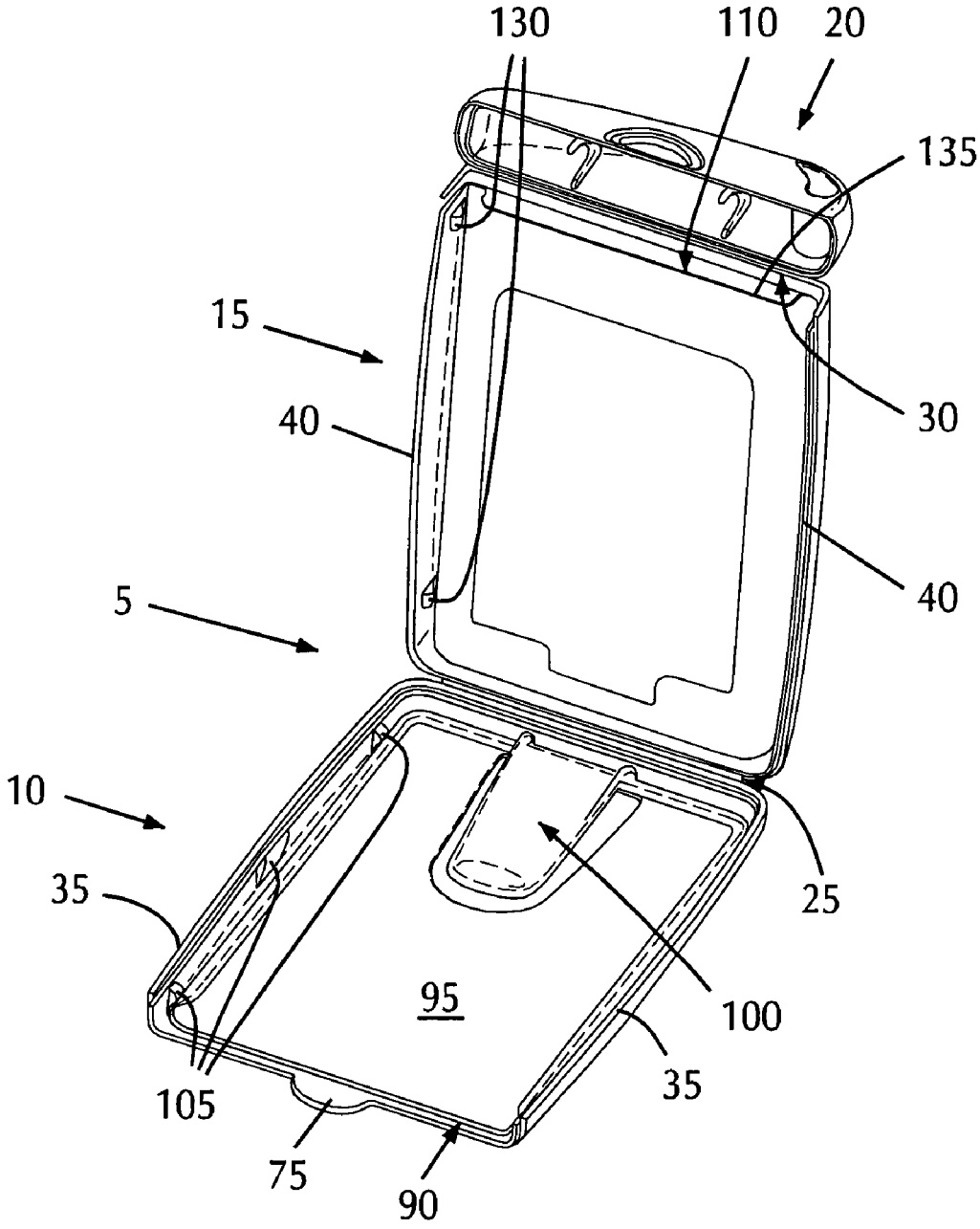
FIG. 6 is a schematic view of the novel carrying case of FIGS. 1-5, but with additional elements on the interior of the carrying case.
Figure 7:
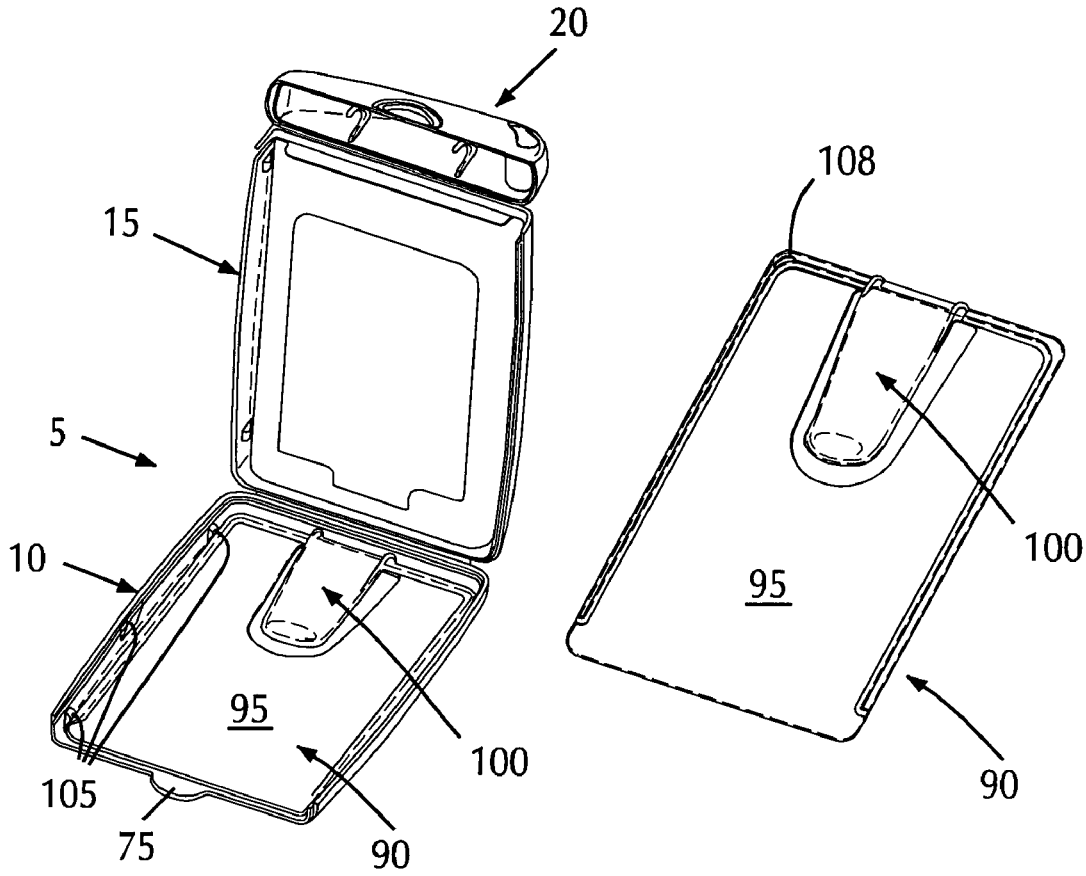
FIG. 7 is a schematic view of the novel carrying case of FIGS. 1-5, showing a removable money clip element.

Thus, for example, and looking now at FIGS. 6 and 7, there is shown a money clip element 90 which generally comprises a flat planar body 95 and a tongue 100. Money clip element 90 is preferably slidably mounted to front panel 10 by sliding flat planar body 95 under grooves/rails/guides 105. Thus, money clip element 90 locks into place, but can be easily removed. The money clip element 90 offers the user a one-piece insert which can hold cash, credit cards, a driver's license, etc.

In addition to the foregoing, it should also be appreciated that money clip element 90 can be unsnapped from front panel 10 and carried by the user as a standalone product (i.e., it may be used separately from carrying case 5). Furthermore, money clip element 90 may be provided with a hole 108 (FIG. 7) for mounting a keychain or the like thereto.

Figure 8:
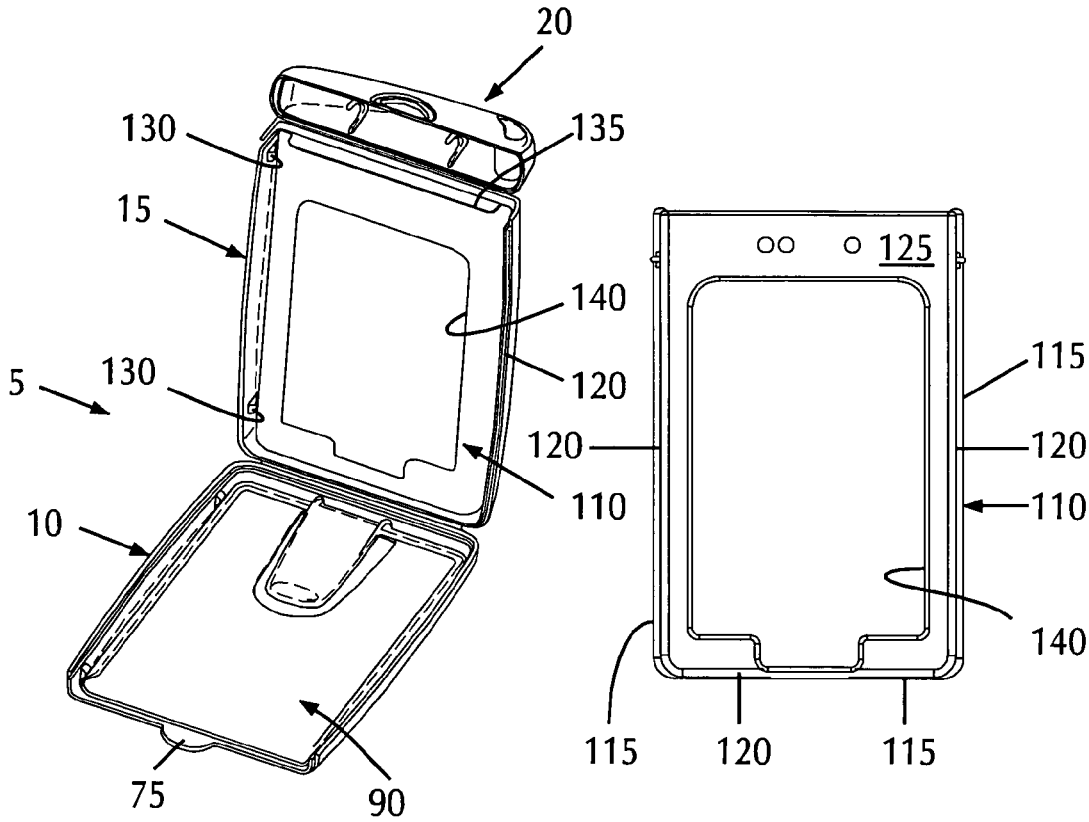
FIG. 8 is a schematic view of the novel carrying case of FIGS. 1-5, showing a cardholder element.
Figure 9:
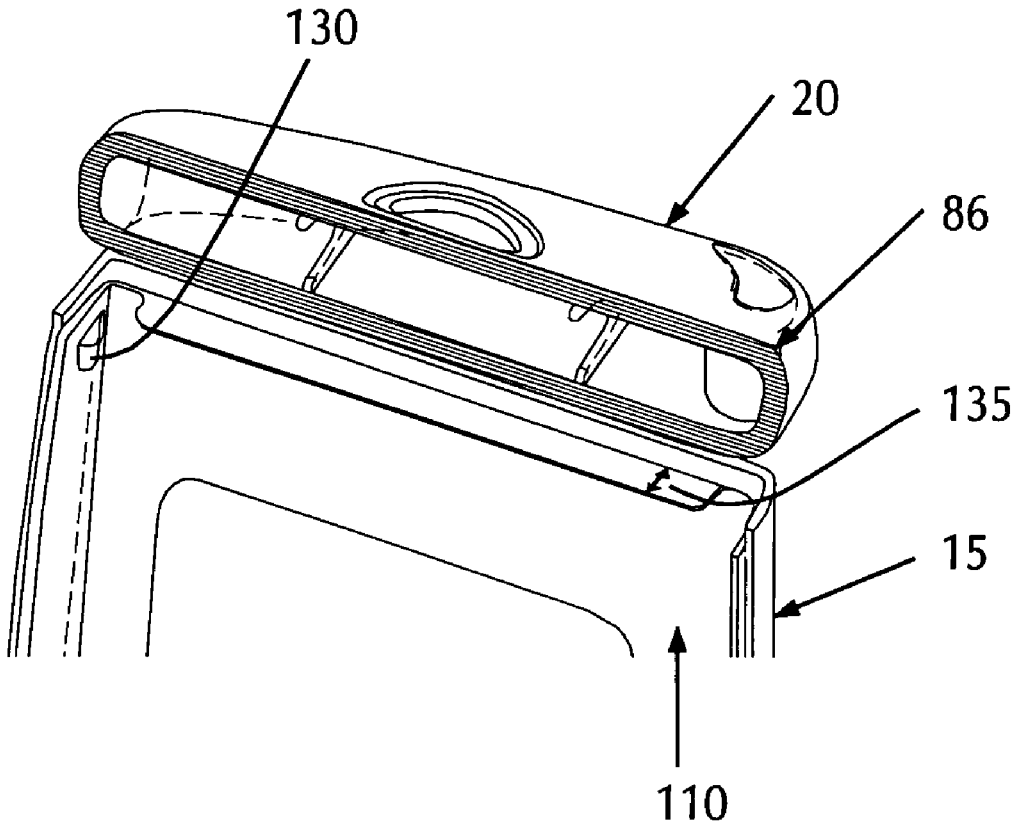
FIG. 9 is an enlarged schematic view the novel carrying case of FIG. 8, and wherein the lid includes a gasket.

Looking next at FIGS. 6 and 8, there is shown a cardholder element 110. Cardholder element 110 can hold credit cards/business card-sized items, e.g., credit cards, identification cards, MP3 players, small flat screen televisions, etc. Cardholder element 110 comprises bases 115, sidewalls 120 (which extend vertically upward from bases 115) and a flat planar body 125 (sitting atop sidewalls 120), whereby cardholder element 110 can be slidably mounted to back panel 15 using grooves/rails/guides 130 so that flat planar body 125 will be offset from the plane of back panel 15, whereby to create a chamber 135 between cardholder element 110 and back panel 15 (FIG. 9). Preferably cardholder element 110 includes a central opening 140 which allows the user to push the innermost card in the compartment out of the top end of the case.

Of course, the positioning of money clip element 90 and cardholder element 110 may be reversed (i.e., cardholder element 110 may be mounted to front panel 10 and money clip element 90 may be mounted to back panel 15).

Furthermore, additional elements may be provided to add additional features to carrying case 5.

Figure 10:
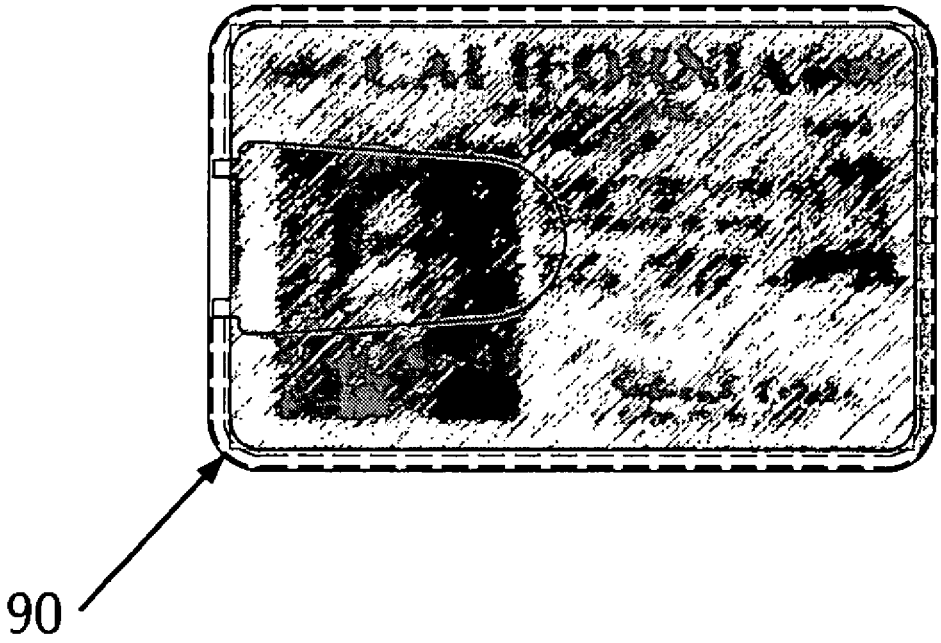
FIG. 10 is a schematic view of a transparent money clip which may be inserted into the novel carrying case of FIGS. 1-5.

If desired, one or more of the additional elements may be formed of a translucent or transparent material (see, for example, FIG. 10, which shows a translucent money clip element 90).

Figure 11:
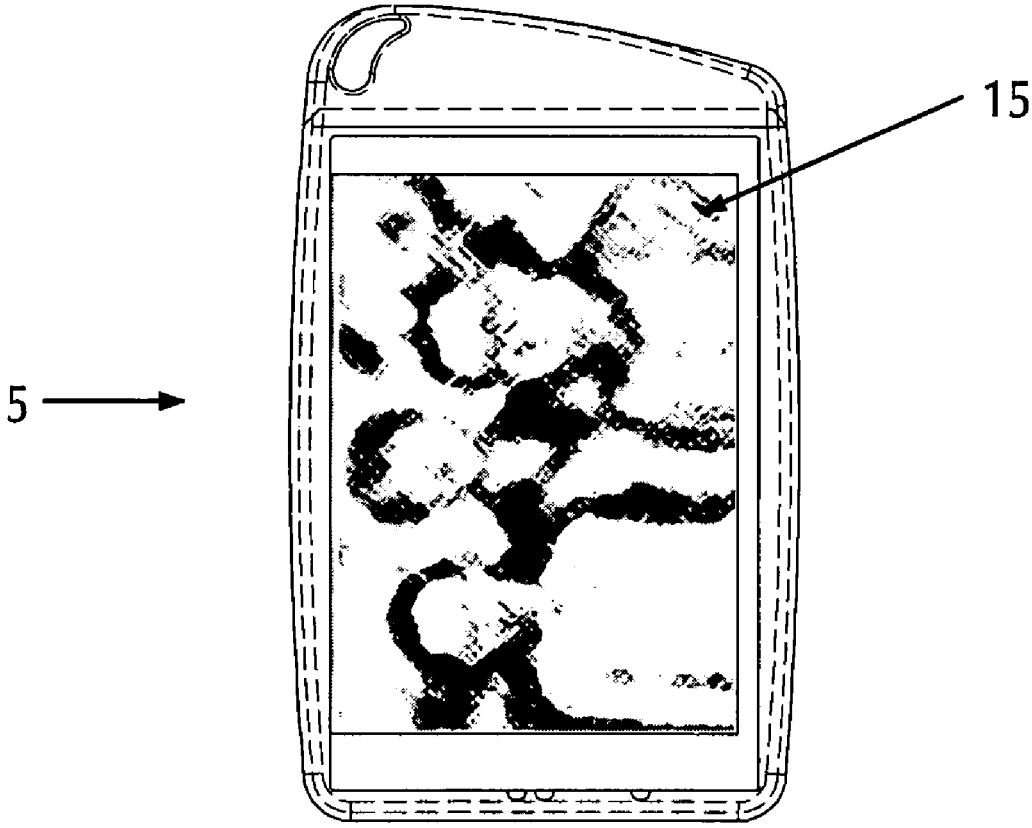
FIG. 11 is a schematic view of the novel carrying case of FIGS. 1-4, wherein at least a portion of the carrying case is transparent.

Additionally, one or more of front panel 10 and/or back panel 15 may be formed of a translucent or transparent material (see, for example, FIG. 11, which shows a transparent back panel 15). This feature allows a photograph or the like (including an electronic still image photo display, an electronic moving image photo display, etc.), mounted inside carrying case 5, to be viewed while the case is closed. Such an arrangement can help personalize the product.

Figure 12:
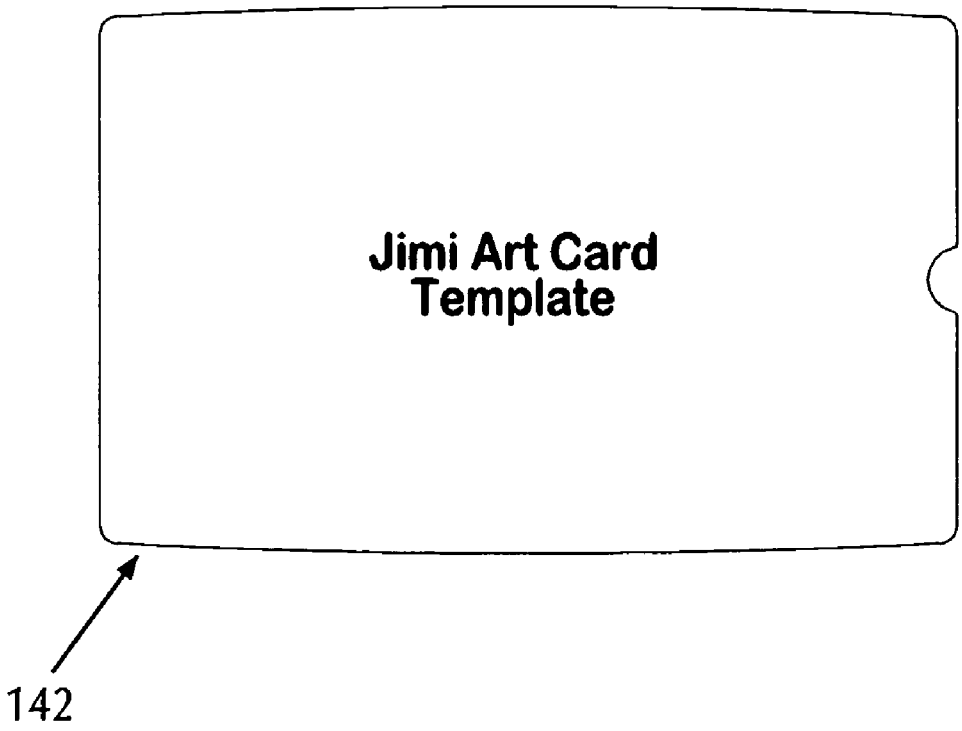

These personal images (e.g., family photographs, kids school drawings, etc.) could be derived from photographs or digital pictures scaled to fit the carrying case. To this end, a template 142 (FIG. 12) may be provided to size these personal images so they will fit in this recessed compartment. The user can then print and cutout the image and slip it into the recessed display window.

Alternatively, a mirrored card, which acts as a mirror, may be provided in place of a photograph being mounted within the carrying case 5.

Examples of other elements which may be configured to be carried by front panel 10 and/or back panel 15 include, but are not limited to, snowboard/skateboarder tools, digital media/memory, bike tools, darts, mini CDs, mini hard drives, videogame cards, golf accessories, credit card sized tools, smart card, MP3 players, other audio players, flat screen televisions, cellular telephones, other communication devices, cameras, video cameras, GPS navigators/receivers, compasses, clocks, personal protection devices (e.g., such as a Taser-like device), lights, videogames, electronic photo displays, waterproof containers for carrying cash, cards, cosmetics, etc. It is also anticipated that speakers may be inserted into front panel 10 and back panel 15, one on each panel, so that the speakers are exposed when the carrying case is opened.

Figure 13:
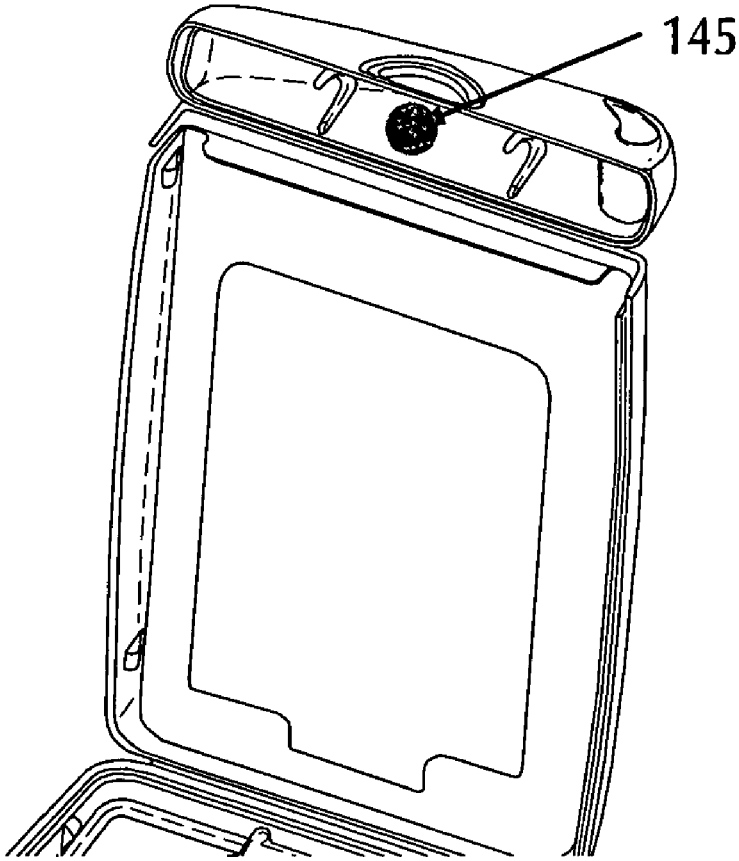
FIG. 13 is a schematic view of the novel carrying case of FIGS. 1-4 including a Radio Frequency ID.

Also, if desired, a Radio Frequency ID (RFID) element 145 (FIG. 13), or similar device, or other electronic tracking device, could be embedded or supplied with the carrying case 5. Such a device can be used to track the location of the carrying case and/or identify its owner if recovered following theft. Furthermore, such a device can function as a child-locator (i.e., as a sort of Lojack for kids) so that a child can be located through the device.

Modifications

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention.

What is claimed is:

1. A carrying case system comprising:

a wallet-sized carrying case for holding personal items, the wallet-sized carrying case comprising:

a substantially rigid rear panel comprising a rectangular planar rear base having first, second, third and fourth sides, wherein the first and third sides are substantially parallel to one another and the second and fourth sides are substantially parallel to one another, and a continuous rear rim upstanding from the first, second and third sides, wherein the continuous rear rim comprises a first portion extending along the first side of the rectangular planar rear base, a second portion extending along the second side of the rectangular planar rear base and a third portion extending along the third side of the rectangular planar rear base;

a substantially rigid front panel comprising a rectangular planar front base having first, second, third and fourth sides, wherein the first and third sides are substantially parallel to one another and the second and fourth sides are substantially parallel to one another, and a continuous front rim upstanding from the first, second and third sides, wherein the continuous front rim comprises a first portion extending along the first side of the rectangular planar front base, a second portion extending along the second side of the rectangular planar front base and a third portion extending along the third side of the rectangular planar front base;

a hinge extending between the second portion of the rear rim and the second portion of the front rim so as to hingedly connect the front panel to the rear panel such that their respective rims can be brought into engagement with one another, with the first portion of the rear rim engaging the first portion of the front rim, the second portion of the rear rim engaging the second portion of the front rim and the third portion of the rear rim engaging the third portion of the front rim, whereby to collectively form a first enclosure which has an open end formed at the fourth side of the rear panel and the fourth side of the front panel, with the open end of the first enclosure being characterized by a first rectangular perimeter;

a releasable locking mechanism for selectively maintaining the front and rear rims in engagement with one another, wherein the releasable locking mechanism comprises a first locking mechanism on the first portion of the rear rim and a corresponding second locking mechanism on the first portion of the front rim, a third locking mechanism on the third portion of the rear rim and a corresponding fourth locking mechanism on the third portion of the front rim; and a lid comprising a rear base, a front base, a first side wall connecting the rear base to the front base, a second side wall connecting the rear base to the front base, and an end base extending between the front base, the rear base, the first side wall and the second side wall, whereby to collectively form a second enclosure with an open end opposite the end base, with the open end of the second enclosure being characterized by a second rectangular perimeter;

wherein the rear base of the lid is hingedly connected, adjacent to the open end of the lid, to the fourth side of the rear base of the rear panel, such that the second rectangular perimeter of the second enclosure can be brought into face-to-face engagement with the first rectangular perimeter of the first enclosure, so as to selectively close off the open end of the first enclosure;

and further wherein when the lid is brought into engagement with the fourth side of the front panel, the rear base of the lid is substantially co-planar with the rear base of the rear panel and the front base of the lid is substantially co-planar with the front base of the front panel.

2. A system according to claim 1 wherein at least a portion of the carrying case is translucent.

3. A system according to claim 1 wherein at least a portion of the carrying case is transparent.

4. A system according to claim 1 wherein the carrying case is splashproof when the lid engages the front panel.

5. A system according to claim 1 wherein the carrying case is waterproof when the lid engages the front panel.

6. A system according to claim 1 wherein the front panel is hingedly connected to the rear panel with a living hinge.

7. A system according to claim 1 wherein the lid is hingedly connected to the rear panel with a living hinge.

8. A system according to claim 1 wherein the lid comprises a hole for connecting the carrying case to another article.

9. A system according to claim 8 wherein the article comprises a loop connected to one selected from the group consisting of a neck attachment, a wrist attachment, a clothing attachment and a keyring.

10. A system according to claim 1 wherein the lid locks the front panel to the rear panel when the lid engages the front panel.

11. A system according to claim 10 wherein the front panel comprise a tongue and the lid comprises a tongue-receiving opening, and further wherein the lid is locked to the front panel when the tongue is received in the tongue-receiving opening.

12. A system according to claim 11 wherein at least one of the front panel and rear panel is sufficiently flexible to release the tongue from the tongue-receiving opening when the front panel is pushed toward the rear panel.

13. A system according to claim 1 wherein one of the rear rim and the front rim includes an exterior recess and the other of the rear rim and the front rim includes an interior recess, so as to facilitate secure mating of the two rims when they are brought into engagement.

14. A system according to claim 1 wherein the system further comprises a money clip element, and further wherein the money clip element is attached to one of the front panel and the rear panel.

15. A system according to claim 14 wherein the money clip element is releasably attached to one of the front panel and the rear panel.

16. A system according to claim 15 wherein the money clip element comprises a planar frame and a tongue flexibly mounted to the planar frame, wherein the front panel or rear panel comprises guides, and further wherein the planar frame is mounted to the panel by sliding the planar frame under the guides.

17. A system according to claim 15 wherein at least a portion of the money clip element is translucent whereby to render visible an identification card attached thereto.

18. A system according to claim 15 wherein the money clip element comprises a hole for connecting the money clip element to another article.

19. A system according to claim 1 wherein the system further comprises a cardholder element, and further wherein the cardholder element is attached to one of the front panel and the rear panel.

20. A system according to claim 19 wherein the cardholder element is releasably attached to one of the front panel and the rear panel.

21. A system according to claim 20 wherein the cardholder element comprises a planar frame with an upstanding rim extending along at least two opposing sides of the planar frame, with the upstanding rim comprising rails, wherein the front panel or rear panel comprises guides, and further wherein the planar frame is mounted to the panel by sliding the rails under the guides so that the planar frame is displaced from the planar body of the panel.

22. A system according to claim 21 wherein the planar frame comprises a hole for providing access to a card disposed in the cardholder element.

23. A system according to claim 1 wherein the system further comprises an element for attachment to one of the front panel and the rear panel, wherein the element comprises one selected from the group consisting of electronic still image photo displays, electronic moving image photo displays, mirrors, snowboard tools, skateboard tools, digital media/memory, bike tools, darts, mini CDs, mini hard drives, videogame cards, golf accessories, credit card sized tools, smart cards, MP3 players, other audio players, televisions, cellular telephones, other communication devices, cameras, video cameras, GPS navigators/receivers, compasses, clocks, personal protection devices, lights, videogames, waterproof containers, cards, cosmetics and speakers.

24. A system according to claim 1 wherein the system further comprises an electronic tracking device.

25. A system according to claim 24 wherein the electronic tracking device comprises a Radio Frequency ID element.

26. A system according to claim 1 wherein a recess is formed in the second portion of the rear rim so that when the rims are brought into engagement, the hinge fits into the recess formed in the second portion of the rear rim.

27. A carrying case system comprising:

a wallet-sized carrying case for holding personal items, the walletsized carrying case comprising:

a substantially rigid front panel comprising a four-sided planar body and an upstanding rim extending along three sides of the foursided planar body;

a substantially rigid rear panel comprising a four-sided planar body and an upstanding rim extending along three sides of the four-sided planar body; and a lid;

wherein the front panel is hingedly connected to the rear panel such that their respective rims can be brought into engagement with one another so as to form an enclosure with an open face; and wherein the lid is hingedly connected to the rear panel such that the lid can be brought into engagement with the front panel so as to close off the open face of the enclosure;

wherein the system further comprises a money clip element, and further wherein the money clip element is attached to one of the front panel and the rear panel;

wherein the money clip element is releasably attached to one of the front panel and the rear panel; and wherein the money clip element comprises a planar frame and a tongue flexibly mounted to the planar frame, wherein the front panel or rear panel comprises guides, and further wherein the planar frame is mounted to the panel by sliding the planar frame under the guides.

28. A carrying case system comprising:

a wallet-sized carrying case for holding personal items, the wallet-sized carrying case comprising:

a substantially rigid front panel comprising a four-sided planar body and an upstanding rim extending along three sides of the four-sided planar body;

a substantially rigid rear panel comprising a four-sided planar body and an upstanding rim extending along three sides of the four-sided planar body; and a lid;

wherein the front panel is hingedly connected to the rear panel such that their respective rims can be brought into engagement with one another so as to form an enclosure with an open face; and wherein the lid is hingedly connected to the rear panel such that the lid can be brought into engagement with the front panel so as to close off the open face of the enclosure;

wherein the system further comprises a money clip element, and further wherein the money clip element is attached to one of the front panel and the rear panel;

wherein the money clip element is releasably attached to one of the front panel and the rear panel; and wherein at least a portion of the money clip element is translucent whereby to render visible an identification card attached thereto.

29. A carrying case system comprising:

a wallet-sized carrying case for holding personal items, the wallet-sized carrying case comprising:

a substantially rigid front panel comprising a four-sided planar body and an upstanding rim extending along three sides of the four-sided planar body;

a substantially rigid rear panel comprising a four-sided planar body and an upstanding rim extending along three sides of the four-sided planar body; and a lid;

wherein the front panel is hingedly connected to the rear panel such that their respective rims can be brought into engagement with one another so as to form an enclosure with an open face; and wherein the lid is hingedly connected to the rear panel such that the lid can be brought into engagement with the front panel so as to close off the open face of the enclosure;

wherein the system further comprises a money clip element, and further wherein the money clip element is attached to one of the front panel and the rear panel;

wherein the money clip element is releasably attached to one of the front panel and the rear panel; and wherein the money clip element comprises a hole for connecting the money clip element to another article.

30. A carrying case system comprising:

a wallet-sized carrying case for holding personal items, the wallet-sized carrying case comprising:

a substantially rigid front panel comprising a four-sided planar body and an upstanding rim extending along three sides of the four-sided planar body;

a substantially rigid rear panel comprising a four-sided planar body and an upstanding rim extending along three sides of the four-sided planar body; and a lid;

wherein the front panel is hingedly connected to the rear panel such that their respective rims can be brought into engagement with one another so as to form an enclosure with an open face; and wherein the lid is hingedly connected to the rear panel such that the lid can be brought into engagement with the front panel so as to close off the open face of the enclosure;

wherein the system further comprises a cardholder element, and further wherein the cardholder element is attached to one of the front panel and the rear panel;

wherein the cardholder element is releasably attached to one of the front panel and the rear panel; and wherein the cardholder element comprises a planar frame with an upstanding rim extending along at least two opposing sides of the planar frame, with the upstanding rim comprising rails, wherein the front panel or rear panel comprises guides, and further wherein the planar frame is mounted to the panel by sliding the rails under the guides so that the planar frame is displaced from the planar body of the panel.

31. A system according to claim 30 wherein the planar frame comprises a hole for providing access to a card disposed in the cardholder element.

* * * * *